US008085279B2

(12) United States Patent
Avagyan et al.

(10) Patent No.: US 8,085,279 B2
(45) Date of Patent: Dec. 27, 2011

(54) DRAWING AN IMAGE WITH TRANSPARENT REGIONS ON TOP OF ANOTHER IMAGE WITHOUT USING AN ALPHA CHANNEL

(75) Inventors: Grigor S. Avagyan, Yerevan (AM); Jeffrey T. Brubaker, Carrboro, NC (US)

(73) Assignee: Synopsys, Inc., Mountain View, CA (US)

( * ) Notice: Subject to any disclaimer, the term of this patent is extended or adjusted under 35 U.S.C. 154(b) by 0 days.

(21) Appl. No.: 12/610,241

(22) Filed: Oct. 30, 2009

(65) Prior Publication Data

US 2011/0102456 A1 May 5, 2011

(51) Int. Cl.
*G09G 5/00* (2006.01)

(52) U.S. Cl. ..... 345/629; 345/582; 345/589; 345/592; 345/600; 345/605

(58) Field of Classification Search ..... None
See application file for complete search history.

(56) References Cited

U.S. PATENT DOCUMENTS

| | | | | |
|---|---|---|---|---|
| 7,184,588 | B2 | 2/2007 | Proteau | |
| 7,345,690 | B2 | 3/2008 | Kim | |
| 7,466,855 | B2 * | 12/2008 | Steele et al. | 382/162 |
| 7,483,042 | B1 * | 1/2009 | Glen | 345/629 |
| 7,486,337 | B2 * | 2/2009 | Bian | 348/589 |
| 7,532,221 | B2 * | 5/2009 | Wetzel | 345/582 |
| 2003/0142090 | A1 | 7/2003 | White | |

* cited by examiner

*Primary Examiner* — Antonio Caschera
(74) *Attorney, Agent, or Firm* — Park, Vaughan, Fleming & Dowler LLP; Laxman Sahasrabuddhe

(57) ABSTRACT

An image display system draws a first image on top of a second image. Pixels of the first image include one or more color channels which encode color information, but do not include an alpha channel which encodes transparency information. The system encodes transparency information for the pixels in the first image using at least one bit in at least one color channel of each pixel. The system draws the first image on top of the second image using the transparency information encoded in the color channels of the pixels to obtain a combined image.

17 Claims, 6 Drawing Sheets

DRAWING AN IMAGE WITH TRANSPARENT REGIONS ON TOP OF ANOTHER IMAGE WITHOUT USING AN ALPHA CHANNEL

BACKGROUND

1. Technical Field

This disclosure generally relates to computer graphics. More specifically, this disclosure relates to methods and apparatus for drawing an image with transparent regions on top of another image without using an alpha channel.

2. Related Art

Designing a circuit can be a tedious process which often requires users to spend many days editing a circuit design using a layout editor. During the design process, users routinely drag objects across the screen of the layout editor to place these objects at a precise location of the circuit design. If the user experiences a slow response from the layout editor, the user is likely to become frustrated, which can decrease productivity. Hence, it is desirable to ensure that the layout editor can move a large number of user-selected objects on the screen without any perceptible lag.

If the system supports an alpha channel for storing transparency information, the objects in the layout editor can be moved efficiently across the screen. However, many systems do not support an alpha channel, and even those that support an alpha channel often have poor performance. In such systems, some conventional techniques have an unacceptable level of lag. Other conventional techniques improve performance by only showing the outlines of the objects that are being moved, which is not ideal because users typically like to see the actual objects, and not just the outlines. Furthermore, if the number of objects that are being moved is very large, even the outline-based approach can experience an unacceptable level of lag.

SUMMARY

Some embodiments of the present invention provide systems and techniques for efficiently drawing a first image with transparent regions, e.g., a background, on top of a second image when there is no support for an alpha channel.

In some embodiments, the system can encode transparency information in one or more color channels of the first image when the system renders the first image. Specifically, the system can encode transparency information of a pixel in the first image using at least one bit in at least one color channel of the pixel. Next, the system can draw the first image on top of the second image using the transparency information encoded in the color channels of the first image's pixels.

Since the transparency information is encoded in the color channels of the first image, the system can render the objects in the first image only once, and thereafter perform efficient pixel-based computations to draw the first image on top of the second image at different locations on the canvas. In this manner, even in the absence of the alpha channel, the system can efficiently draw a first image with transparent regions on top of a second image.

When drawing the first image on top of the second image, the system draws pixel P1 of the first image if the transparency information encoded in pixel P1 indicates that the pixel is opaque. The system draws pixel P2 of the second image which corresponds to pixel P1 in the first image, if the transparency information encoded in pixel P1 indicates that pixel P1 is transparent. Note that these pixel-based computations can be performed very efficiently, and the performance of these pixel-based computations does not depend on the number of objects in the first image.

In some embodiments, the system encodes transparency information in the first image as follows. The system sets the value of one or more color channels to zero for all background pixels in the first image. The system then sets a bit in a color channel to one for pixels which are associated with an opaque area in the first image. For example, the system can use the least significant bit of the blue channel to encode transparency information.

In some embodiments, the system can draw the first image on top of the second image by setting pixel values in the second image to zero which correspond to opaque pixels in the first image, and performing an exclusive-OR combination between the pixels of the first image and the pixels of the second image.

In some embodiments, the system can draw the first image on top of the second image by first determining an image mask using the transparency information encoded in the one or more color channels of the first image pixels, such that the image mask pixels contain transparency information for corresponding pixels of the first image. Then, the system can use the image mask to draw the first image on top of the second image. Note that the system determines the image mask without rendering any objects; instead, the system determines the image mask by extracting the transparency information that is encoded in the color channels.

The first image which is drawn on top of the second image can be a user-selected area in the second image. Prior to drawing the first image on top of the second image, the system can receive a location in the second image where the first image is to be drawn. For example, a user can select an area of the second image by highlighting the area using a mouse cursor. Then, as the user drags the selected area over the second image, the system can determine where on the second image to draw the first image based at least on the location of the mouse cursor.

As explained above, since the system encodes transparency information in the color channels, the system does not need to render the opaque shapes in the first image every time the mouse cursor moves. This enables the system to move the opaque shapes in the first image in real time without a perceptible lag.

In some embodiments, the system can draw the first image at multiple locations on the second image. For example, the first image may correspond to a cell which is to be drawn at multiple locations on the canvas. Instead of rendering the cell at multiple locations, the system can render the cell once and encode the transparency information of the pixels in the color channels. Next, the system can draw the cell (without rendering any of the objects) at the multiple locations using the transparency information encoded in the color channels.

Note that embodiments of the present invention do not require specialized hardware support for processing transparency information. Specifically, even with standard graphics hardware, these embodiments can substantially improve the performance of drawing an image with transparent regions on top of another image.

DETAILED DESCRIPTION

The following description is presented to enable any person skilled in the art to make and use the embodiments, and is provided in the context of a particular application and its requirements. Various modifications to the disclosed embodiments will be readily apparent to those skilled in the art, and the general principles defined herein may be applied to other embodiments and applications without departing from the spirit and scope of the present disclosure. Thus, the present invention is not limited to the embodiments shown, but is to be accorded the widest scope consistent with the principles and features disclosed herein.

The data structures and code described in this detailed description are typically stored on a computer-readable storage medium, which may be any device or medium that can store code and/or data for use by a computer system. The computer-readable storage medium includes, but is not limited to, volatile memory, non-volatile memory, magnetic and optical storage devices such as disk drives, magnetic tape, CDs (compact discs), DVDs (digital versatile discs or digital video discs), or other media capable of storing computer-readable media now known or later developed.

The methods and processes described in the detailed description section can be embodied as code and/or data, which can be stored in a computer-readable storage medium as described above. When a computer system reads and executes the code and/or data stored on the computer-readable storage medium, the computer system performs the methods and processes embodied as data structures and code and stored within the computer-readable storage medium.

Furthermore, methods and processes described herein can be included in hardware modules or apparatus. These modules or apparatus may include, but are not limited to, an application-specific integrated circuit (ASIC) chip, a field-programmable gate array (FPGA), a dedicated or shared processor that executes a particular software module or a piece of code at a particular time, and/or other programmable-logic devices now known or later developed. When the hardware modules or apparatus are activated, they perform the methods and processes included within them.

Systems and Techniques for Displaying Images

Embodiments of the present invention provide systems and techniques for efficiently drawing one image on top of a second image without using an alpha channel. Some embodiments can display a detailed image of an object as a user drags the object over another image, without requiring the user's computer system to have hardware support for alpha channel rendering.

Figure 1:
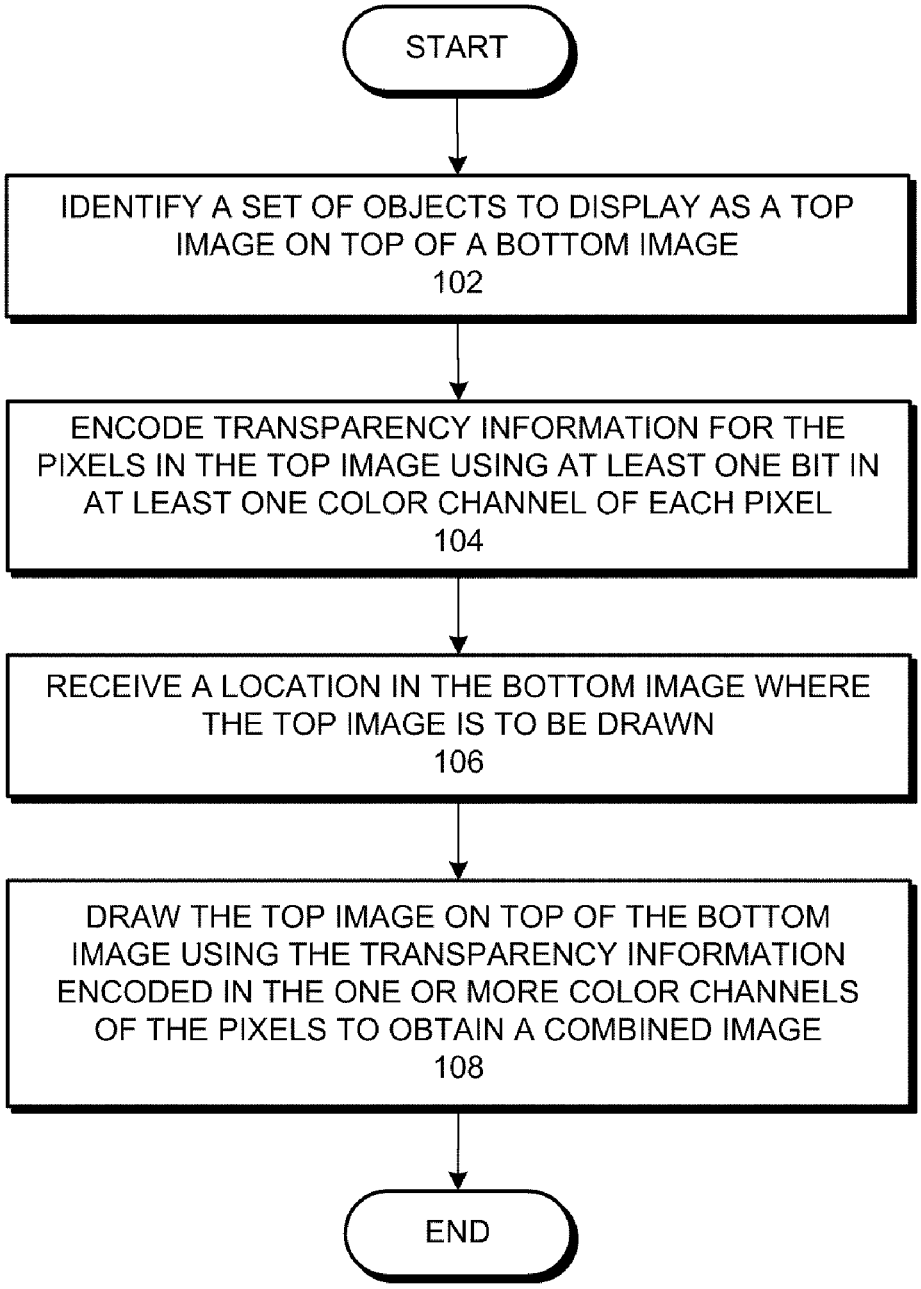
FIG. 1 presents a flow chart illustrating a process for drawing one image on top of another image in accordance with an embodiment of the present invention.

FIG. 1 presents a flow chart illustrating a process for drawing one image on top of another image in accordance with an embodiment of the present invention. The process can be performed by a computer system which stores instructions and executes these instructions using a processing unit such as a microprocessor. The system can begin by identifying a set of objects to display as a top image on top of a bottom image (operation 102). Then, the system can generate the top image so that it includes the identified set of objects. The top image can be generated in response to a user command, e.g., a cut-and-paste command, a move command, etc.

When the system generates the top image, the system encodes transparency information for the pixels in the top image using at least one transparency-encoding bit in at least one color channel of each pixel (operation 104). For example, the system can set the at least one color channel to zero for all background pixels in the top image, and can set the transparency-encoding bits to one for pixels which are associated with the opaque area (i.e., the pixels which are associated with the set of objects). Note that this operation incurs no additional cost since these pixels need to be drawn anyways.

Then, the system can receive a location in the bottom image where the top image is to be drawn (operation 106). The system then draws the top image on top of the bottom image using the transparency information encoded in the one or more color channels of the pixels to obtain a combined image (operation 108).

Figure 2:
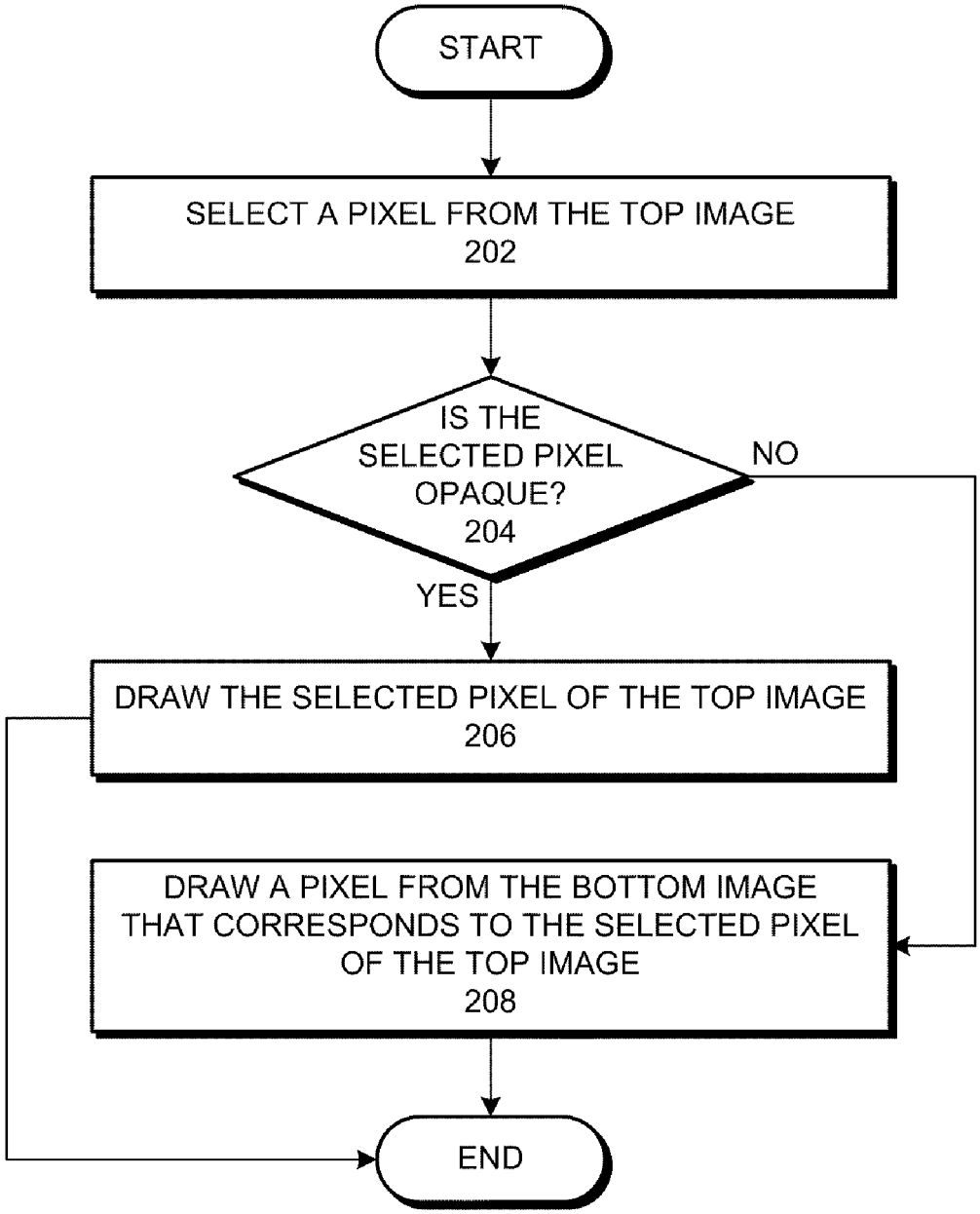
FIG. 2 presents a flow chart illustrating a process for drawing a pixel in accordance with an embodiment of the present invention.

FIG. 2 presents a flow chart illustrating a process for drawing a pixel in accordance with an embodiment of the present invention. Note that operations 202-208 can expand upon operation 108 of FIG. 1. The system can begin by selecting a pixel from the top image (operation 202). Next, the system determines whether the selected pixel is opaque (operation 204). If so, the system draws the selected pixel of the top image (operation 206). Otherwise, if the system determines that the selected pixel is transparent, the system draws a pixel from the bottom image that corresponds to the selected pixel of the top image (operation 208).

Note that in operation 204, the system can analyze a color channel for the pixel that encodes transparency information (e.g., the blue channel) to determine whether the least significant bit (LSB) for the color channel is equal to a zero or a one. If the LSB is equal to zero, the system determines that the pixel is transparent. Otherwise, if the LSB is equal to one, the system determines that the pixel is opaque. In another embodiment, these assignments can be reversed, i.e., if the LSB is equal to zero, it indicates that the pixel is opaque, and if the LSB is equal to one, it indicates that the pixel is transparent. In general, some embodiments of the present invention ensure that the drawn pixels can be differentiated from the background pixels with respect to one or more bit planes.

Figure 3:
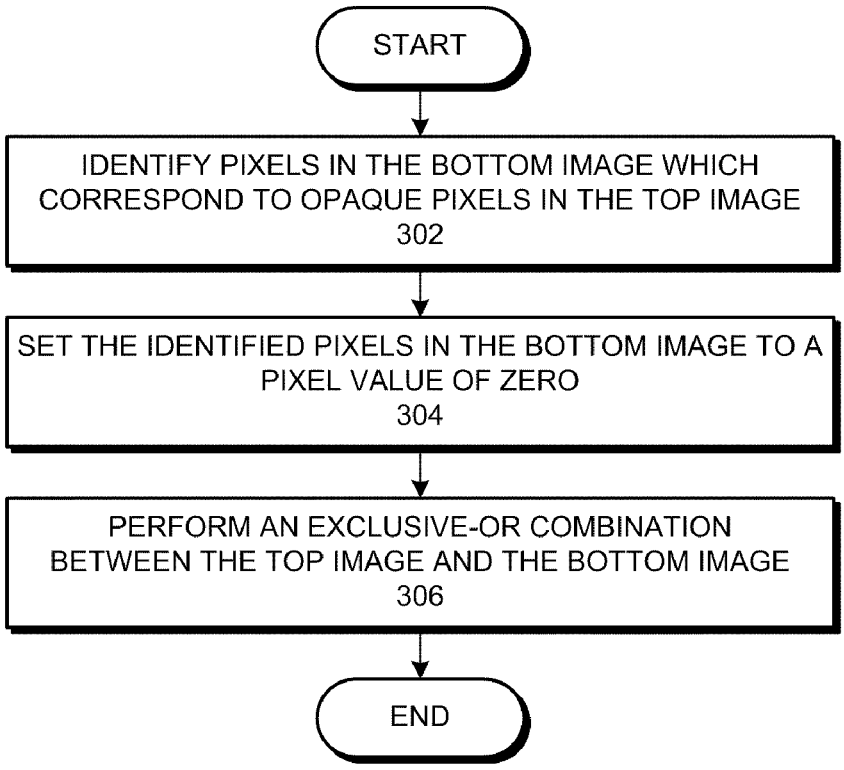
FIG. 3 presents a flow chart illustrating a process for drawing one image on top of another image in accordance with an embodiment of the present invention.

FIG. 3 presents a flow chart illustrating a process for drawing one image on top of another image in accordance with an embodiment of the present invention. Note that operations 302-306 can expand upon operation 108 of FIG. 1. The system can begin by identifying pixels in the bottom image which correspond to opaque pixels in the top image (operation 302). Then, the system sets the identified pixels in the bottom image to a pixel value of zero (operation 304), i.e., it blanks out the areas in the bottom image that correspond to opaque areas in the top image. The system then performs an exclusive-OR combination between the top image and the bottom image to generate a combined image (operation 306).

Note that the exclusive-OR combination of the top image and the bottom image causes the system to draw either a pixel from the top image, or a pixel from the bottom image. Since the system blanked out areas in the bottom image that correspond to opaque areas in the top image, the exclusive-OR operation will ensure that these areas in the combined image include the opaque objects from the top image.

Table 1 presents an exemplary pseudocode for drawing one image on top of another image in accordance with an embodiment of the present invention. Specifically, lines 1-6 draw a "source_pixmap" image on top of a "destination_pixmap" image. Lines 1-2 configure the graphics context variable "gcand" to have a black foreground and a white background. In lines 3-4, the literal "1L" identifies the least significant bit of source_pixmap, which encodes transparency information. Furthermore, the XCopyPlane function draws the foreground pixel of gcand (i.e., a black pixel) on a pixel for destination_pixmap whenever a corresponding pixel in source_pixmap has its least significant bit equal to one. Then, in lines 5-6, a graphics context "gcxor" causes the XCopyArea function to perform an exclusive-OR operation between the destination_pixmap and the source_pixmap.

TABLE 1

```
1.  XSetForeground(display, gcand, 0);
2.  XSetBackground(display, gcand, ~0);
3.  XCopyPlane(display, source_pixmap, destination_pixmap,
4.          gcand, 0, 0, width, height, 0, 0, 1L);
5.  XCopyArea(display, source_pixmap, destination_pixmap,
6.      gcxor, 0, 0, width, height, 0, 0);
```

Figure 4:
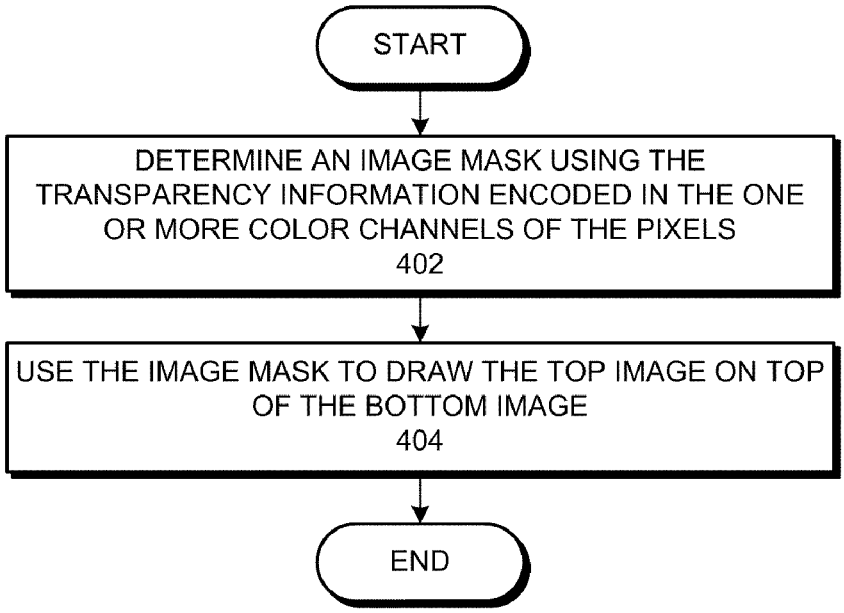
FIG. 4 presents a flow chart illustrating a process for using a mask to draw one image on top of another in accordance with an embodiment of the present invention.

FIG. 4 presents a flow chart illustrating a process for using a mask to draw one image on top of another in accordance with an embodiment of the present invention. Note that operations 402-404 can expand upon operation 108 of FIG. 1. The system can begin by determining an image mask using the transparency information encoded in the one or more color channels of the pixels (operation 402). The image mask is itself an image where a pixel is black (i.e., all zeros) if it corresponds to a transparent pixel of the top image, and is white (i.e., all ones) if it corresponds to an opaque pixel of the top image.

Then, the system uses the image mask to draw the top image on top of the bottom image (operation 404). In doing so, the system draws a pixel from the top image if a corresponding pixel from the image mask is not black (i.e., not all zeros). Otherwise, the system draws a corresponding pixel from the bottom image.

Table 2 presents an exemplary pseudocode for drawing one image on top of another image in accordance with an embodiment of the present invention. Specifically, lines 1-6 produce an image mask from the "source_pixmap," and then use the image mask to draw the "source_pixmap" on top of the "destination_pixmap." Lines 1-2 configure the graphics context variable "gccopy" to have a white foreground and a black background. In lines 3-4, the literal "1L" identifies the least significant bit of "source_pixmap," which encodes transparency information. Furthermore, the XCopyPlane function draws the foreground pixel of "gccopy" (i.e., a white pixel) on a pixel for "mask" whenever a corresponding pixel in "source_pixmap" has its least significant bit equal to one. Next, line 5 configures "gccopy" to use "mask" as the clip mask. Then, in lines 6-7, the "gccopy" graphics context configures the XCopyArea function to draw a pixel from "source_pixmap" whenever a corresponding pixel of "mask" is white, and to draw a pixel from "destination_pixmap" whenever the corresponding pixel of "mask" is black.

TABLE 2

```
1.  XSetForeground(display, gccopy, ~0);
2.  XSetBackground(display, gccopy, 0);
3.  XCopyPlane(display, source_pixmap,
4.          mask, gccopy, 0, 0, width, height, 0, 0, 1L);
5.  XSetClipMask(display, gccopy, mask);
6.  XCopyArea(display, source_pixmap, destination_pixmap,
7.      gccopy, 0, 0, width, height, 0, 0);
```

Figure 5:
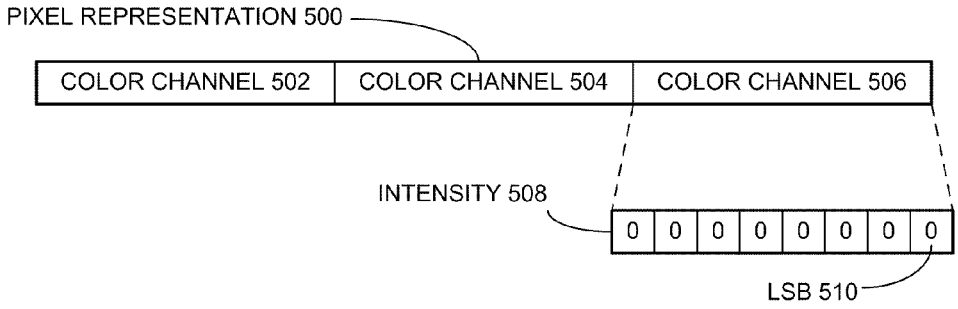
FIG. 5 illustrates a representation for a pixel that encodes transparency information in accordance with an embodiment of the present invention.

FIG. 5 illustrates the color channels of a pixel that encodes transparency information in accordance with an embodiment of the present invention. Pixel representation 500 includes color channels 502-506 which can store intensity information for the different colors (e.g., intensity 508 for color channel 506).

In some embodiments, pixel representation 500 can use the RGB (red-green-blue) color model, such that color channels 502, 504, and 506 represent a red channel, green channel, and blue channel, respectively.

Pixel representation 500 can encode transparency information in one or more bits of the color channels. Specifically, in some embodiments, the system encodes transparency information in the least-significant bit of the blue color channel (i.e., LSB 510 of intensity 508). Note that changing the intensity of the blue channel can give the pixel a slightly bluish hue. However, this difference would be imperceptible to the user if the color depth is sufficiently large.

Then, when the system draws one image on top of another, the system can determine whether a pixel on the top image is transparent by determining whether LSB 510 is equal to zero. If LSB 510 is equal to zero, the system draws a corresponding pixel of the bottom image. Otherwise, if LSB 510 is equal to one, the system draws the pixel for the top image.

Figure 6:
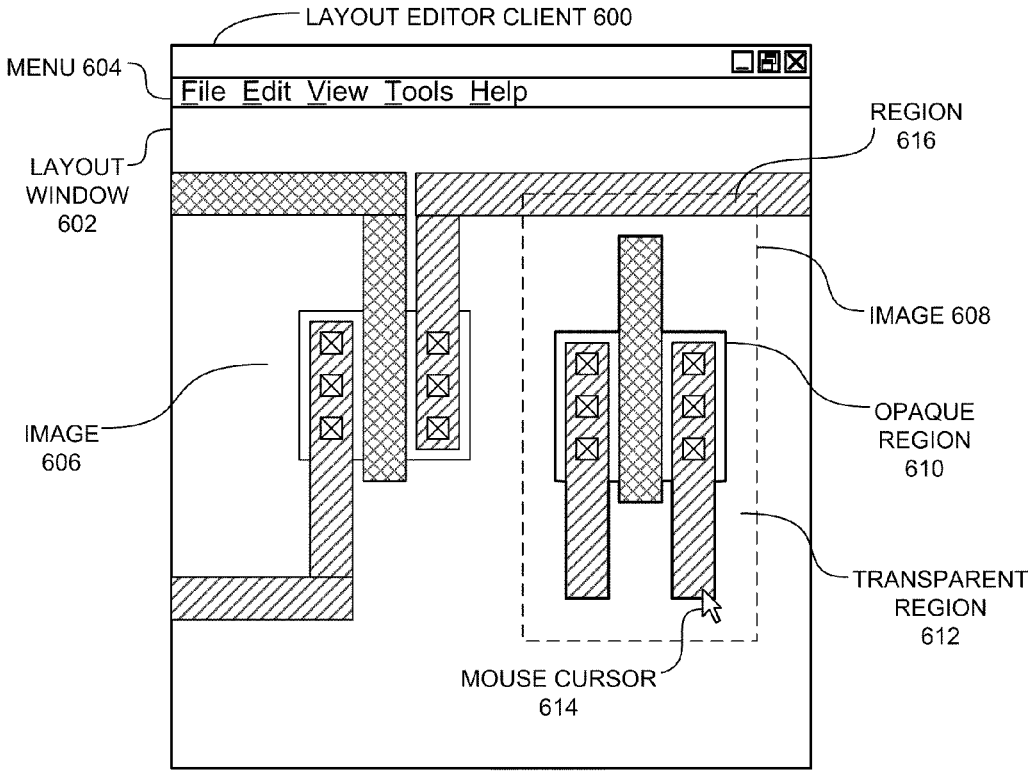
FIG. 6 illustrates a layout editor client that draws one image with a transparent region on top of another image in accordance with an embodiment of the present invention.

FIG. 6 illustrates a layout editor client that draws one image with transparent regions, e.g., a background, on top of another image in accordance with an embodiment of the present invention. A user can view a layout editor client 600 on a computer display, and can interact with layout editor client 600 using an input device such as a keyboard and/or a mouse. Furthermore, layout editor client 600 can include a layout window 602 and a menu 604. More specifically, layout window 602 can display an image 606, which can include a set of circuit layout objects for a circuit design.

During operation, a user can interact with layout editor client to place and/or move objects on layout window 602. For example, a user can use a mouse cursor 614 to provide placement information for a set of circuit layout objects. Furthermore, a user can select a menu option from menu 604 (or can press a key combination on a keyboard) to paste a set of circuit layout objects. Then, in response to receiving placement information from the user, layout editor client 600 can draw image 608 that includes the set of circuit layout objects.

A user can also use mouse cursor 614 to highlight a set of objects which have already been drawn on image 606. Then, in response to receiving the selection information from the user, layout editor client 600 can draw image 608 that includes a copy of the highlighted set of objects from image 606.

Image 608 includes an opaque region 610 and a transparent region 612. If a pixel of image 608 is opaque (i.e., in opaque region 610), layout editor client 600 draws the opaque pixel of image 608. Otherwise, if a pixel of image 608 is transparent (i.e., in transparent region 612), layout editor client 600 draws a corresponding pixel from image 606 (e.g., a pixel from region 616).

Layout editor client 600 can leave image 608 highlighted until the user deselects the set of objects drawn in image 608.

For example, the system can draw a solid or dashed line surrounding image 608 (e.g., the dashed line around image 608). The system can also draw a solid or dashed line surrounding the highlighted set of objects to identify the opaque region of image 608 (e.g., the dark solid line surrounding opaque region 610). A user can use mouse cursor 614 to drag the highlighted set of objects to a new location of layout window 602, and layout editor client 600 responds by efficiently drawing image 608 on top of a different region of image 606.

Figure 7:
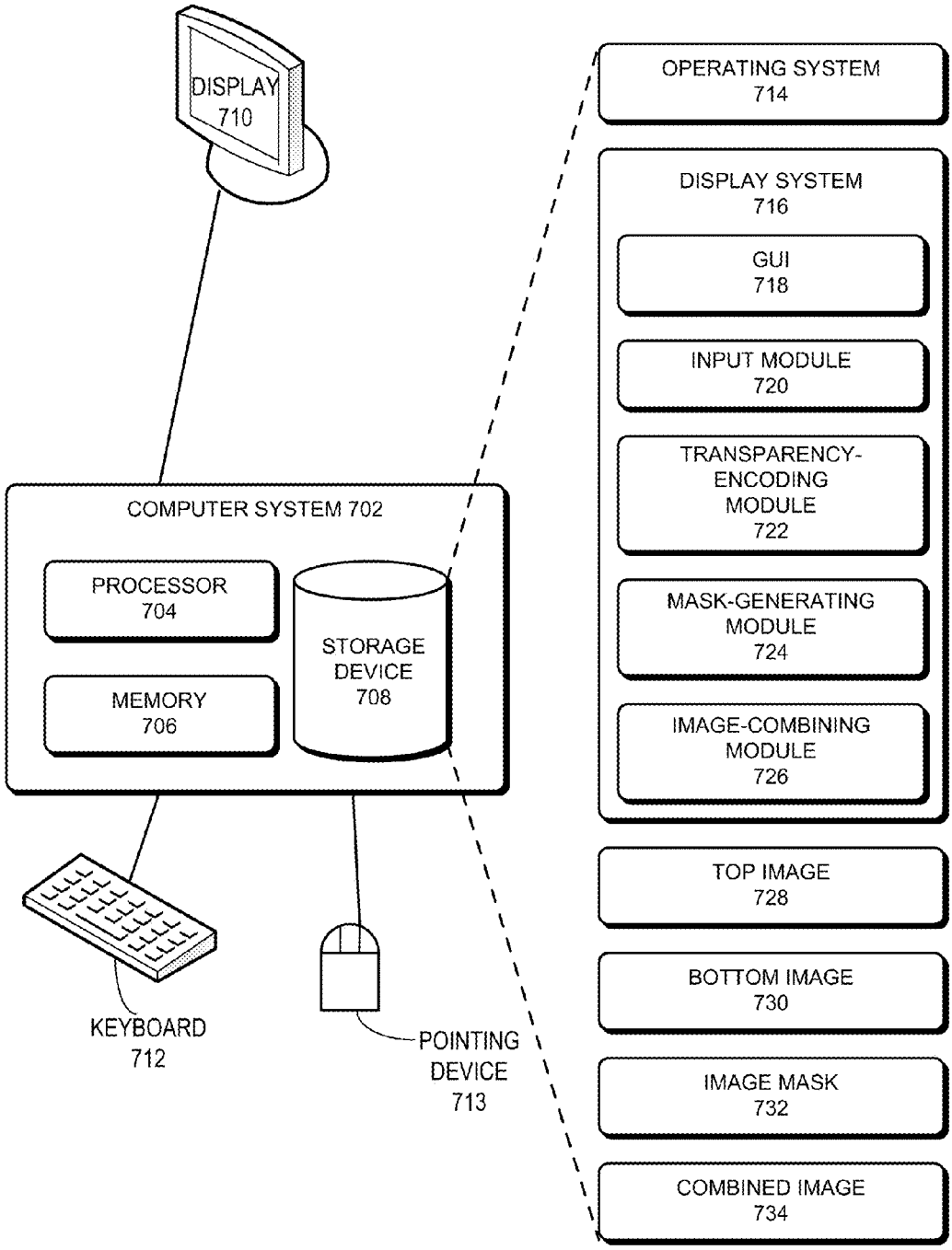
FIG. 7 illustrates an exemplary computer system that facilitates drawing one image on top of another image in accordance with an embodiment of the present invention.

FIG. 7 illustrates an exemplary computer system that facilitates drawing one image on top of another image in accordance with an embodiment of the present invention. Computer system 702 includes a processor 704, a memory 706, and a storage device 708. Furthermore, computer system 702 can be coupled to a display device 710, a keyboard 712, and a pointing device 713.

Storage device 708 stores an operating system 714, a display system 716, a top image 728, a bottom image 730, an image mask 732, and a combined image 734. Display system 716 can include a graphical user interface (GUI) 718, an input module 720, a transparency-encoding module 722, a mask-generating module 724, and an image-combining module 726.

During operation, display system 716 is loaded from storage device 708 into memory 706 and is executed by processor 704. Display system 716 can receive a selection from a user for a set of objects to display as top image 728 on top of bottom image 730. In response, transparency-encoding module 722 can encode transparency information in top image 728 to identify background pixels that are not associated with the selected objects. Then, image-combining module 726 draws top image 728 on top of bottom image 730 using the transparency information encoded in top image 728 to obtain combined image 734. In some embodiments, mask-generating module 724 can generate image mask 732 that identifies the transparent pixels of top image 728, and image-combining module 726 uses image mask 732 to draw top image 728 on top of bottom image 730.

Figure 8:
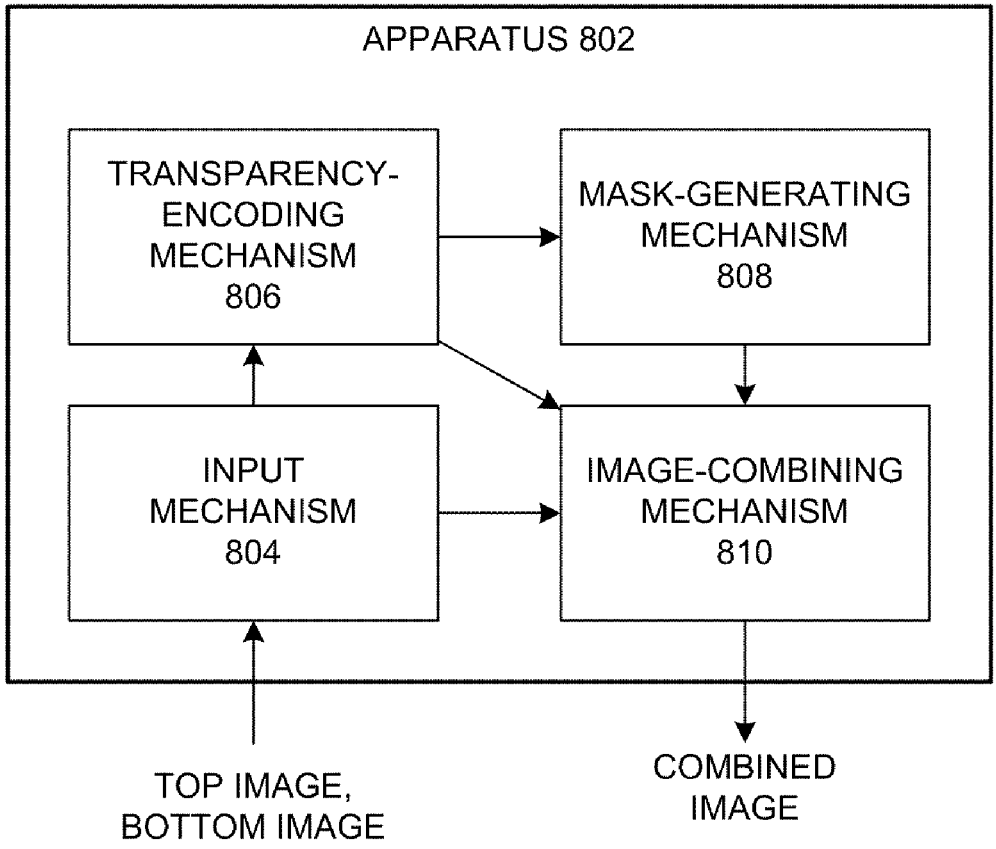
FIG. 8 illustrates an apparatus that facilitates drawing one image with a transparent region on top of another image in accordance with an embodiment of the present invention.

FIG. 8 illustrates an apparatus that facilitates drawing one image with a transparent region on top of another image in accordance with an embodiment of the present invention. Apparatus 802 can comprise a number of mechanisms which may communicate with one another via a wired or wireless communication channel. Apparatus 802 may be realized using one or more integrated circuits, and it may be integrated in a computer system, or it may be realized as a separate device which is capable of communicating with other computer systems and/or devices. Specifically, apparatus 802 can include an input mechanism 804, a transparency-encoding mechanism 806, a mask-generating mechanism 808, and an image-combining mechanism 810.

In some embodiments, input mechanism 804 takes as input a top image and a bottom image. In response, transparency-encoding mechanism 806 can encode transparency information in the top image to identify the opaque and transparent areas in the top image. Then, image-combining mechanism 810 draws the top image on top of the bottom image using the transparency information encoded in the top image to obtain a combined image. In some embodiments, mask-generating mechanism 808 can generate an image mask that identifies the opaque and transparent pixels of the top image, and image-combining mechanism 810 uses the image mask to draw the top image on top of the bottom image.

The foregoing descriptions of various embodiments have been presented only for purposes of illustration and description. They are not intended to be exhaustive or to limit the present invention to the forms disclosed. Accordingly, many modifications and variations will be apparent to practitioners skilled in the art. Additionally, the above disclosure is not intended to limit the present invention.

What is claimed is:

1. A computer-implemented method for drawing a first image on top of a second image, wherein a first pixel of the first image includes one or more color channels which encode color information, but does not include an alpha channel which encodes transparency information, the method comprising:

receiving transparency information for the first pixel in the first image, wherein a set of bits represents a color of the first pixel, and wherein the set of bits does not include bits from an alpha channel;

modifying, using a computer, a subset of the set of bits based on the transparency information for the first pixel;

drawing the first pixel of the first image if the subset of the set of bits indicates that the first pixel is opaque, wherein the first pixel is drawn using a color that is determined using all of the bits in the set of bits; and drawing a second pixel of the second image if the subset of the set of bits indicates that the first pixel is transparent, wherein the second pixel in the second image corresponds to the first pixel in the first image.

2. The method of claim 1, wherein a first color channel's value is equal to zero for all background pixels in the first image, and wherein modifying a subset of the set of bits includes setting a bit in the first color channel to one for pixels which are associated with an opaque area in the first image.

3. The method of claim 1, further comprising:

setting pixel values in the second image to zero which correspond to opaque pixels in the first image; and performing an exclusive-OR combination between the first image and the second image.

4. The method of claim 1, further comprising:

determining an image mask based on the subset of the set of bits, wherein the image mask pixels contain transparency information for corresponding pixels of the first image; and using the image mask to draw the first image on top of the second image.

5. The method of claim 1, wherein the first image is a user-selected area in the second image.

6. The method of claim 5, wherein prior to drawing the first image on top of the second image, the method further includes receiving a location in the second image where the first image is to be drawn.

7. A non-transitory computer-readable storage medium storing instructions that when executed by a computer cause the computer to perform a method for drawing a first image on top of a second image, wherein a first pixel of the first image includes one or more color channels which encode color information, but does not include an alpha channel which encodes transparency information, the method comprising:

receiving transparency information for the first pixel in the first image, wherein a set of bits represents a color of the first pixel, and wherein the set of bits does not include bits from an alpha channel;

modifying a subset of the set of bits based on the transparency information for the first pixel;

drawing the first pixel of the first image if the subset of the set of bits indicates that the first pixel is opaque, wherein the first pixel is drawn using a color that is determined using all of the bits in the set of bits; and drawing a second pixel of the second image if the subset of the set of bits indicates that the first pixel is transparent, wherein the second pixel in the second image corresponds to the first pixel in the first image.

8. The non-transitory computer-readable storage medium of claim 7, wherein a first color channel's value is equal to zero for all background pixels in the first image, and wherein modifying a subset of the set of bits includes setting a bit in the first color channel to one for pixels which are associated with an opaque area in the first image.

9. The non-transitory computer-readable storage medium of claim 7, further comprising:

setting pixel values in the second image to zero which correspond to opaque pixels in the first image; and performing an exclusive-OR combination between the first image and the second image.

10. The non-transitory computer-readable storage medium of claim 7, further comprising:

determining an image mask based on the subset of the set of bits, wherein the image mask pixels contain transparency information for corresponding pixels of the first image; and using the image mask to draw the first image on top of the second image.

11. The non-transitory computer-readable storage medium of claim 7, wherein the first image is a user-selected area in the second image.

12. The non-transitory computer-readable storage medium of claim 11, wherein prior to drawing the first image on top of the second image, the method further includes receiving a location in the second image where the first image is to be drawn.

13. An apparatus for drawing a first image on top of a second image, wherein a first pixel of the first image includes one or more color channels which encode color information, but does not include an alpha channel which encodes transparency information, the apparatus comprising:

a receiving mechanism configured to receive transparency information for the first pixel in the first image, wherein a set of bits represents a color of the first pixel, and wherein the set of bits does not include bits from an alpha channel;

a modifying mechanism configured to modify a subset of the set of bits based on the transparency information for the first pixel; and a drawing mechanism configured to:

draw the first pixel of the first image if the subset of the set of bits indicates that the first pixel is opaque, wherein the first pixel is drawn using a color that is determined using all of the bits in the set of bits; and draw a second pixel of the second image if the subset of the set of bits indicates that the first pixel is transparent, wherein the second pixel in the second image corresponds to the first pixel in the first image.

14. The apparatus of claim 13, wherein a first color channel's value is equal to zero for all background pixels in the first image; and wherein the modifying mechanism is configured to set a bit in the first color channel to one for pixels which are associated with an opaque area in the first image.

15. The apparatus of claim 13, wherein the drawing mechanism is configured to:

set pixel values in the second image to zero which correspond to opaque pixels in the first image; and perform an exclusive-OR combination between the first image and the second image.

16. The apparatus of claim 13, further comprising a mask-generating mechanism configured to determine an image mask based on the subset of the set of bits, wherein the image mask pixels contain transparency information for corresponding pixels of the first image; and wherein the drawing mechanism is configured to use the image mask to draw the first image on top of the second image.

17. The apparatus of claim 13, wherein the first image is a user-selected area in the second image.

* * * * *